US011041295B2

(12) United States Patent
Foss

(10) Patent No.: US 11,041,295 B2
(45) Date of Patent: Jun. 22, 2021

(54) APPARATUS AND METHOD FOR TREATING AND PREVENTING ODORS

(71) Applicant: Jonathan G. Foss, Waconia, MN (US)

(72) Inventor: Jonathan G. Foss, Waconia, MN (US)

( * ) Notice: Subject to any disclaimer, the term of this patent is extended or adjusted under 35 U.S.C. 154(b) by 0 days.

(21) Appl. No.: 16/438,648

(22) Filed: Jun. 12, 2019

(65) Prior Publication Data

US 2019/0360186 A1 Nov. 28, 2019

Related U.S. Application Data

(63) Continuation-in-part of application No. 15/629,626, filed on Jun. 21, 2017, now abandoned.

(60) Provisional application No. 62/326,133, filed on Apr. 22, 2016.

(51) Int. Cl.

| | |
|---|---|
| ***E03D 9/00*** | (2006.01) |
| ***E03D 9/03*** | (2006.01) |
| *E03D 9/02* | (2006.01) |

(52) U.S. Cl.

CPC ..... *E03D 9/005* (2013.01); *E03D 9/007* (2013.01); *E03D 9/032* (2013.01); *E03D 2009/028* (2013.01)

(58) Field of Classification Search

CPC ..... E03D 9/005; E03D 9/007; E03D 9/032; E03D 2009/028

USPC ..... 4/223

See application file for complete search history.

(56) References Cited

U.S. PATENT DOCUMENTS

| | | | | |
|---|---|---|---|---|
| 6,029,286 | A * | 2/2000 | Funk | E03D 9/005 4/223 |
| 10,767,357 | B2 * | 9/2020 | Kazes | A61L 9/20 |
| 2007/0136937 | A1 * | 6/2007 | Sawalski | B65D 83/759 4/223 |
| 2010/0031982 | A1 * | 2/2010 | Hornsby | E03D 9/005 134/169 R |
| 2010/0205731 | A1 * | 8/2010 | Muhlhausen | E03D 9/005 4/223 |
| 2018/0223517 | A1 * | 8/2018 | Wood | E03D 9/005 |

* cited by examiner

*Primary Examiner* — Huyen D Le

(74) *Attorney, Agent, or Firm* — J.A. Lindeman & Co., PLLC

(57) ABSTRACT

This disclosure relates to systems, methods, and compositions for dispensing multiple compositions into a plurality of containers or atmospheres. In one embodiment, this disclosure pertains to treating and preventing offensive odors arising from toilets. The system includes a base station with at least one bag-on-valve (BOV) canister, which holds one or more compositions. A tube leads from the output of the bag-on-valve canister to a bowl clip and/or to a spray nozzle. The bowl clip can be mounted to a toilet bowl. One example embodiment of the invention includes a bowl clip with a sensor that initiates release of the composition(s) from the bag-on-valve (BOV) canister(s), while another embodiment initiates release of the composition(s) from the bag-on-valve (BOV) canister(s) using a motion sensor or activation switch. The compositions are delivered to treat and prevent offensive odors.

16 Claims, 6 Drawing Sheets

FIG. 4A
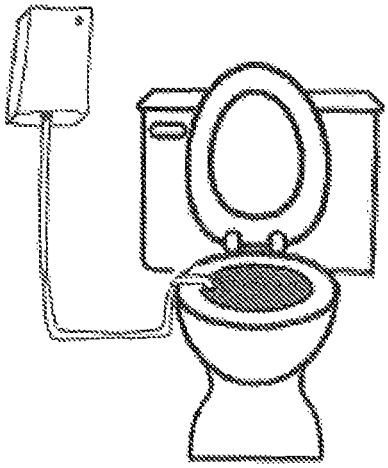
FIG. 4B
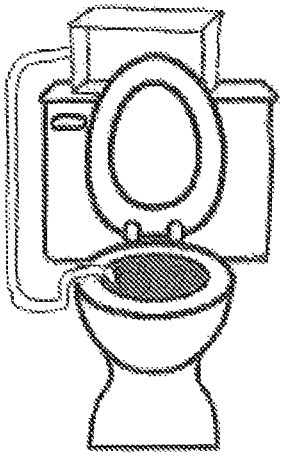
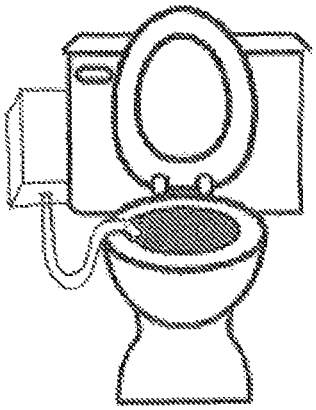
FIG. 4C
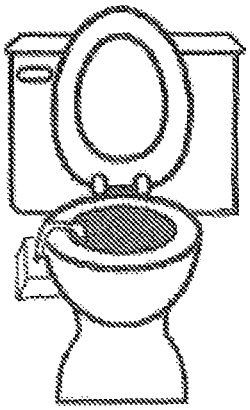
FIG. 4D

APPARATUS AND METHOD FOR TREATING AND PREVENTING ODORS

CROSS REFERENCE TO RELATED APPLICATIONS

This application is a continuation-in-part application of pending U.S. patent application Ser. No. 15/629,626, filed on Jun. 21, 2017, and claims the benefit of U.S. Provisional Patent Application No. 62/326,133, entitled "Apparatus and Method for Treating and Preventing Odors," filed Apr. 22, 2016. The entire contents of both applications are incorporated by reference in this application.

TECHNICAL FIELD

This disclosure relates to the sanitization and cleaning industries. In particular, this disclosure relates to an apparatus and methods for cleaning and sanitizing bathrooms and toilets.

BACKGROUND

On average, people eliminate fecal waste between 1 to 3 times per day. Usually people eliminate their fecal waste into a toilet or similar waste disposal system. This fecal elimination process often brings about unwanted odors on account of metabolic byproducts that are contained in feces and/or accompany the evacuation process. These odors originate from the toilet area, where the fecal evaluation takes place and the waste is collected for subsequent disposal. Left untreated, the waste generates odors, which diffuse into the air and adjacent areas.

Popular remedies for toilet related odors include air circulation systems and air fresheners. Air circulation systems, such as fans, replace the contaminated air with fresh air. Air fresheners typically introduce pleasant fragrances to mask unwanted toilet odors. Air fresheners are available in many forms, such as sprays, heated oils, solids, and gels.

Despite existing products for treating bathroom air, the state of art suffers from several limitations. For example, sprays that are used in bathrooms typically treat only the air around the toilet, i.e., the ambient atmosphere. Such sprays do not target the source of the problem, which is the fecal waste in the toilet and odorous volatile molecules emanating from that waste. Most sprays only cover the odor by dispersing fragrances into the area with the unwanted odor. Such air fresheners do not treat the source of the odor itself.

No existing systems or methods treat both the source of the odor problem and also resulting odors. Accordingly, there exists a need to target both the source of the odor and the ambient atmosphere affected by the odor. In particular, there exists a need to treat both the odor source and the affected surrounding air with compositions targeting both the source of the odor problem and the unwanted odors themselves. Accordingly, there exists a need for systems, methods, and devices, for deploying multiple targeted compositions to multiple different places in and around a toilet.

SUMMARY

The apparatus and method for treating and preventing odors in accordance with the claimed invention can be used to treat both water and air, such as in a bathroom environment where treatment of the water in the toilet bowl reduces and eliminates odors at the source, while treating the ambient air eliminates detection of the odors.

In one example embodiment of the invention, the apparatus includes a base unit, a bowl clip, and a tube that connects the base unit to the bowl clip. The base unit houses a bag-on-valve (BOV) canister with at least one composition that is released to treat and prevent odors. The apparatus can have either single or multiple (bags with a single valve) in a single container or multiple BOV containers (canisters) in a larger base unit housing. The base unit can be hidden from view when mounting the base unit behind or below the bowl and can also be mounted on top of a toilet tank and camouflaged. Similarly, the base unit also can be wall-mounted. The bowl clip has a minimal footprint to attach the tube used to deliver the composition from the base unit to the water/air in the toilet bowl. Previous systems included cumbersome and unwieldy mechanics within the toilet bowl itself that led to unreliable and unpredictable performance.

In one example embodiment of the invention, the apparatus uses an electrical or mechanical device trigger to release a predetermined amount of the composition with consistency and accuracy, thereby constituting an improvement over prior systems that use mechanical pressure to squeeze or spray a solution. Where the released composition can be a liquid under pressure, for example, the metered release used in the invention does not depend upon travel of the toilet seat or a mechanical force of a person sitting on the toilet seat to dispense the composition. In other example embodiments, the apparatus can include springs or rubber lifts to support the toilet seat and cover and activate when a pressure of a human (5 pounds of more) is exerted. Previous systems do not include this feature.

As alluded to above, one example embodiment of the invention uses a higher-pressure (for example 30-120 psi) bag-on-valve (BOV) to emit a spray or liquid composition. In another embodiment of the invention, the apparatus can use a low-pressure bag on valve (for example, 2 to 10 psi) to deliver a liquid composition. The apparatus of the invention can dispense a predetermined amount of liquid or spray composition depending on the pressure and size of the BOV and the width and length of the tube. Prior systems did not have this flexibility. In one example embodiment of the invention, the apparatus includes inert gases pressuring a sealed bag (BOV), which will not harm the environment as gaseous propellants such as low boiling point alkanols and chloro- and floral alkanes.

One example embodiment of the invention maintains pressure in the BOV by using a solenoid or mechanical device to pressurize the BOV only when necessary (e.g., when delivery of the composition is imminent) and switching off when delivery of the composition is not imminent. The apparatus of the invention can use a single BOV for months or even years and much longer than previous systems. Over time and number of uses, the apparatus can provide an audible or visual indication when the bag on valve container is empty or needs a refill. Similarly, the apparatus can include an LED (or other) light that also can serve the additional function as a night light.

In some example implementations of the invention, the bag-on-valve can include a clear plastic bottle and/or a clear bag, allowing the user to see the volume of liquid(s) remaining in the BOV can(s). Other examples of the invention include the use of non-staining colored compositions (for example, blue and green) that can easily be seen in a bag as a way to monitor composition levels. Bactericide and viralcide coatings on the BOV and attachments can also be incorporated into the apparatus. In past systems, these features were not provided.

In one example embodiment of the invention, the apparatus uses a pressure sensor to detect minute differences in the pressure of the composition in the BOV as well as in the trigger mechanism in some systems. In some example embodiments, the trigger mechanism (e.g., a solenoid) can be used in conjunction with a separate valve to initiate/control release of the composition. The pressure sensor can be battery powered, and the batteries can be powered by a solar panel or a wired or plug-in solution.

In addition to dispensing the composition based on changes in pressure, the claimed invention also can dispense the composition to treat the space (e.g., ambient air, air in bowl, water in bowl, etc.) based upon an elapsed time since last triggering, a time of day, a number of uses, and other time and number-based determinations. In some example embodiments of the invention, the base unit can also sense when a person is near the toilet and does not need to rely on pressure on the toilet seat to activate. Previous systems have been reliant upon a stroke distance to release the compositions.

Additionally, the apparatus of the invention can combine sensed pressure, time, and proximity considerations as a trigger to release the composition. For example, the apparatus can compensate for someone getting on or off the toilet and not dispense multiple sprays in a short period of time. It can also release the composition based upon a drop in pressure, such as when a user is finished sitting on the toilet seat and stands, thereby removing pressure from a switch or sensor. The system can emit a liquid or spray when the sitting pressure is reduced and for a predetermined period of time afterwards.

In some example embodiments of the invention, the apparatus can be equipped with a sensor mounted in the base unit and/or in the bowl clip with a sensor to sense contaminants in the air. Based upon a predetermined level of contaminants, the system can release the composition into the ambient air, into the air in the bowl, and/or into the water in the bowl as needed.

In one example implementation of the invention, the apparatus is a connected device that is connected to a communications network, such as the Internet via wired, Wi-Fi, Bluetooth, or other network connection to monitor and track use of the apparatus, including the number of deployment of the composition(s) and amounts remaining or used of the composition(s). When a predetermined amount is reached, the apparatus can provide notification to a computing device when the BOV container is empty or requires a refill.

In one example embodiment of the invention, the apparatus can include multiple compositions and composition types that can seal the surface area of the toilet water with an oil stopping smell; a fragrance to treat the atmosphere; a disinfectant to treat bacteria viruses in the toilet bowl; and/or a chemical to treat rust and water stains. The apparatus can use an essential oil, or other hydrophobic polymer, oil, or chemical that seals the surface of the toilet water, creating an odorless environment that previously was fouled by human waste. This oil, which also can be scented, is not evident in previous systems.

The bowl clips of the invention are much thinner in profile than in previous systems and thus may cause less torque on the toilet seat, reducing the cantilever action on the bolts that hold a seat on, thereby ensuring longevity of the device and the toilet seat itself. The apparatus can be made in a fully disposable form with a flexible bracket and arm extending from the BOV container. Extending the bracket when removing the apparatus from its packaging can also serve to activate the battery.

The tube from the base unit to the bowl clip can be contoured to form-fit a toilet rim and position the device to be minimally visible when a toilet seat is in a down position. The bowl clip can include an integral or separate clamping device to provide a secure fit.

The invention includes an apparatus for dispensing an odor-eliminating chemical composition, such as for deodorizing a toilet and/or a bathroom. The apparatus includes a base station, a tube, and a bowl clip. The base station includes a container storing the chemical composition and a solenoid for enabling a dispensing flow of the chemical composition from the container. The container can be a bag-on-valve (BOV) container or a pump bottle, for example. The chemical composition can be pressurized within the container. Additionally, the chemical composition can include at least one of an oil, a natural oil, a perfume, a surfactant, an alcohol, a soap, an odor absorber, a cyclodextrin, an oxidant, an acid, a base, and an antiseptic.

The solenoid is operatively connected to the container and is responsive to an activation signal indicative of a dispensing condition. The dispensing condition can include receipt of an actuation signal from a sensor. The sensor can be mounted to the bowl clip and/or to the base unit. Additionally, the dispensing condition can include receipt of an actuation signal from a switch.

The invention also includes a tube, which includes a proximal end and a distal end, where the proximal end of the tube receives the dispensing flow of the chemical composition from the container and directs the dispensing flow of the chemical composition to the distal end of the tube.

The invention also includes a bowl clip, which includes a mounting piece and a nozzle, where the nozzle receives the dispensing flow of the chemical composition from the distal end of the tube and disperses the chemical composition. In some embodiments of the invention, the chemical composition is dispersed to ambient air in a toilet bowl. In some embodiments of the invention, the chemical composition is dispersed to ambient air outside a toilet bowl, such as in a bathroom, a stall, and a lavatory. In some embodiments of the invention, the dispersed chemical composition includes an oil that seals surface area of water in a toilet bowl to stop odors from the toilet bowl from emanating.

The apparatus can also include a battery power supply in the base station. The battery power supply can provide actuation power to the solenoid for dispensing flow of the chemical composition from the container upon receipt of the activation signal indicative of the dispensing condition. The apparatus can also include a mounting bracket extending from the base station to the bowl clip, where extending the mounting bracket activates the battery power supply.

In some example embodiments of the invention, the apparatus can also include an ultraviolet (UV) light operatively connected to the bowl clip and further positioned to radiate ambient air in a toilet bowl to provide further disinfectant action.

BRIEF DESCRIPTION OF THE DRAWINGS

FIGS. 4A-4D show an example base station, tube, and bowl clip in accordance with the invention positioned in a variety of configurations.

DETAILED DESCRIPTION

Disclosed herein is a new apparatus for dispensing chemical compositions, for example dispensing multiple compositions into two or more spaces. Disclosed herein is a new apparatus for eliminating bathroom odors. Also disclosed herein are new methods for eliminating bathroom odors.

Figure 1:
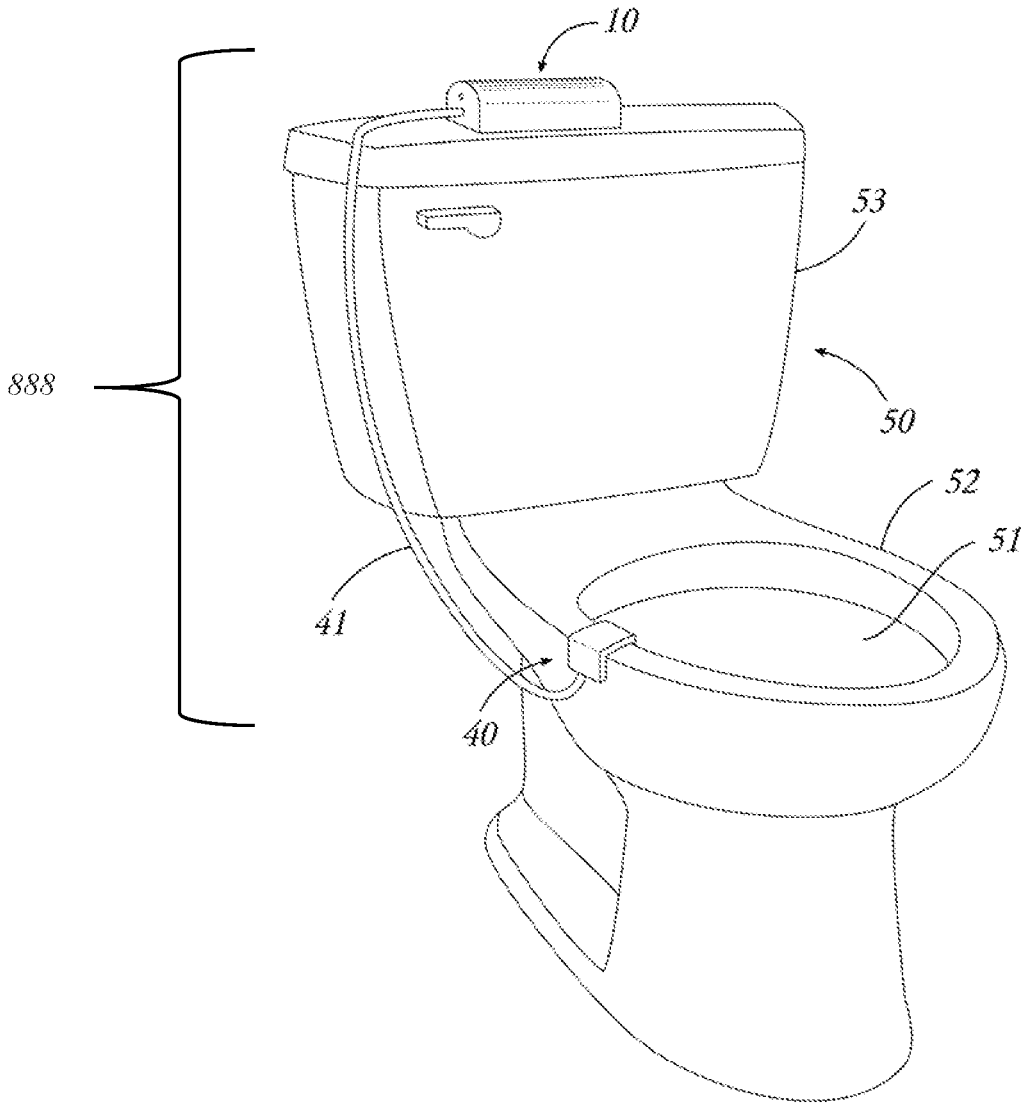
FIG. 1 shows an apparatus in accordance with one example embodiment of the invention with a base station, tube, and bowl clip implemented in a top mount configuration.
Figure 5:
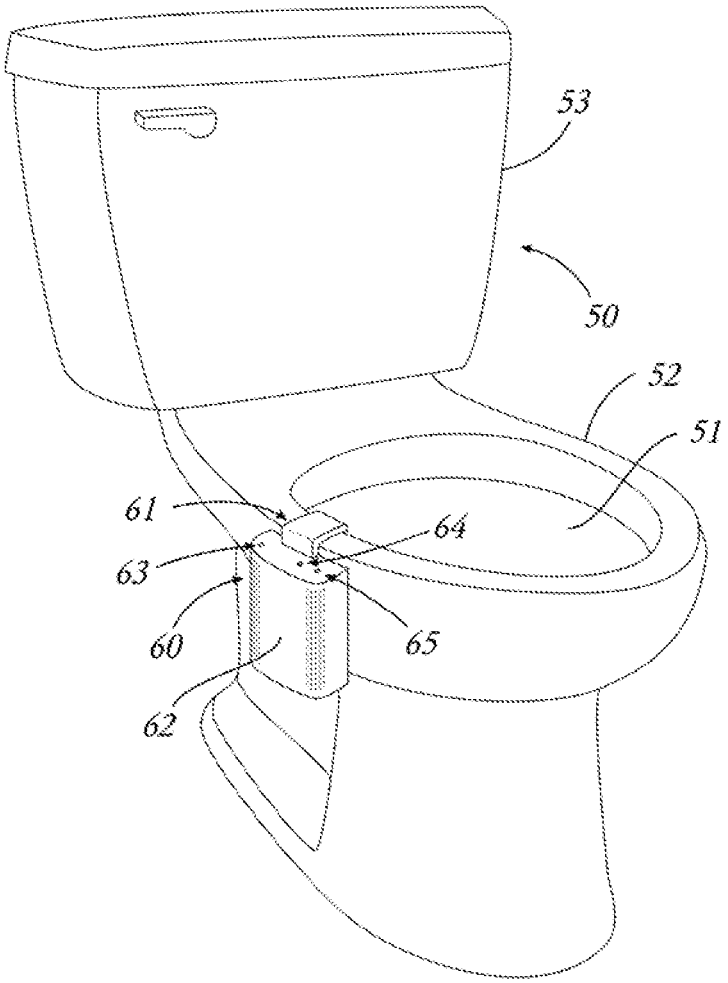
FIG. 5 shows an apparatus in accordance with one example embodiment of the invention with an integrated base station, tube, and bowl clip implemented in a rim-mounted configuration.

One example embodiment of the invention relates to an apparatus for eliminating bathroom odors. In one example embodiment, the apparatus includes a base station that stores an odor-eliminating composition and a bowl clip that delivers the composition to a toilet bowl. A customer may buy the claimed invention in single or multipacks (e.g., one for each toilet) in either a disposable rim-mounted version (for example, as shown in FIG. 5) or wall, floor, or toilet top-mount versions (as shown in FIGS. 1 and 4, for example). The claimed invention may include different dispensed compositions with different smells and features. The bowl clip and base station of the apparatus may be white in color or other colors matched to the color of the toilets so as to camouflage the apparatus. In one example embodiment, once unwrapped from the packaging, the arm of the disposable rim mounted version will unfurl or otherwise extend into the hanging position. In some embodiments of the invention, to open the packaging, a user removes a tab, which activates the battery. The user positions the bowl clip on the toilet rim and the base station in proximity to the toilet. In some embodiments of the invention, the user initiates the release of the deodorizing composition for the first time by putting downward pressure on the toilet seat to activate a switch in the bowl clip.

In some embodiments of the invention, when a user sits on the toilet seat, the downward pressure from the seat initiates the release of a small amount of hydrophobic oil, which is sprayed or poured over the toilet water in the bowl. The oil seals the top surface of the toilet water thereby preventing odors from escaping from the bowl. When the user leaves the toilet seat, the downward pressure on the seat is released, and a different spray or an additional spray can be dispensed. The different or additional spray can be dispensed immediately or after a predetermined delay time to allow time for the toilet to be flushed.

The base station including a trigger mechanism, such as a solenoid, and a battery (or other power supply) is mounted in the base station or on top of a bag-on-valve canister. The canister may be made of clear plastic with a plastic inner bag allowing for visual inspection of remaining composition. In one example embodiment, the canister may also include a light and/or provide a sound that can go off when downward pressure is applied to the toilet seat in order to indicate when the canister is nearly empty.

The base station of the invention can be mounted on a wall, on the floor, or on the back of the toilet. Similarly, the base station can be integrated with the bowl clip and mounted with the bowl clip to the toilet bowl. A tube leads from the base station to the bowl clip. In some embodiments of the invention, the tube is unwrapped and placed behind the toilet so as to not be in the way of the normal function of the toilet. In some embodiments of the invention, the unwrapping action removes a tab, thereby activating the battery. In some embodiments of the invention, a user initiates the release of the deodorizing compositions for the first time by activating a switch, such as push button 621 shown in FIG. 6, for example. In other embodiments of the invention, the system can be activated by a motion sensor detecting motion and sending an activation signal to the apparatus to release a composition.

The functionality of the wall, floor, or back-of-toilet mounted versions is similar to the disposable rim mounted version but uses a greater volume of oil, larger batteries, different sensors, different signals, and the ability to apply different compositions to the different areas of the room. For example, a base station 60 shown in FIG. 6 can dispense a scented aerosol to the bowl, an oil spray to the surface of the water in the bowl, and a scented aerosol to the surrounding room. The wall, floor, or back-of-toilet mounted version may also have an option for refilling the apparatus.

FIG. 1 is a drawing of a toilet 50 where the present invention is implemented as a toilet top mount apparatus 888. The toilet 50 includes a toilet bowl 51, a toilet rim 52, and a toilet tank 53. The base station 10 of the apparatus 888 is mounted on the toilet tank 53. The bowl clip 40 of the apparatus 888 is placed on the toilet bowl rim 52. The base station 10 is connected to the bowl clip 40 by the tube 41 of the apparatus 888.

Figure 2:
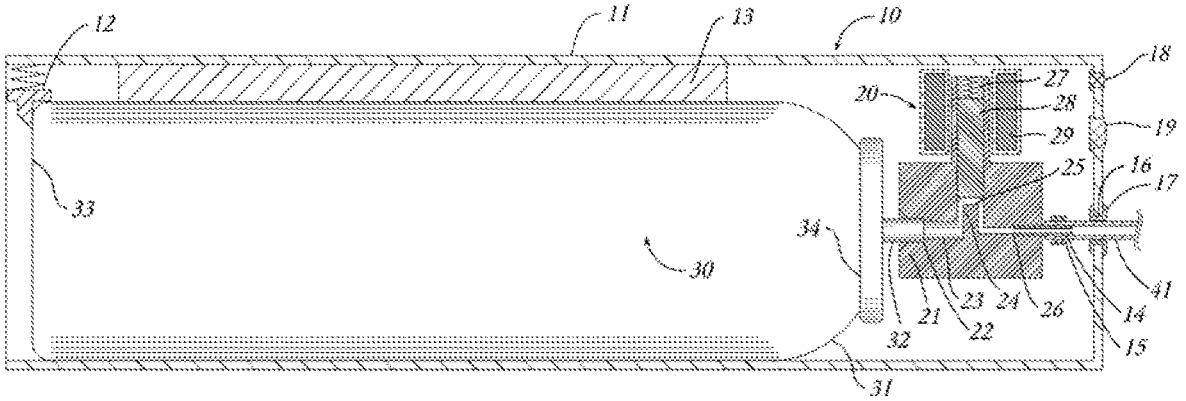
FIG. 2 is a drawing of an example base station in accordance with the invention and the internal components of the base station.

FIG. 2 is a cross-sectional drawing of the base station 10. The base station 10 includes a solenoid 20 and a bag-on-valve (BOV) canister 30. The base station is enclosed by an external housing 11. Within the external housing 11 a spring clip 12 holds and secures the bag-on-valve canister 30. Additionally, there is a rib 13 within the base station 10 that aligns the bag-on-valve canister 30 within the external housing 11 for proper functioning of the solenoid 20. The base station 10 is connected to the tube 41 by a protrusion 14. The tube 41 is attached to the protrusion 14 using a clamp 15. There is a hole 16 in the external housing 11 that allows the tube 41 to pass through the external housing 11. The hole 16 includes a grommet 17 to protect the tube 41 while passing through the external housing 11. The external housing 11 also includes a sensor 18 and an LED indicator 19. Sensor 18 can be a motion sensor installed and calibrated to detect motion in proximity to the base station 10. The detected motion can initiate the release of a composition from the base station 10 by activating the solenoid 20.

The solenoid 20 has a body 21. Within the solenoid body 21 there is a hole with an interface 22 that connects the bag-on-valve (BOV) canister 30 to the solenoid 20. The contents of the bag-on-valve (BOV) canister 30 travel through the hole with interface 22 into a flow path 23 to a solenoid valve flow path 24. From the solenoid valve flow path 24 the contents of the BOV canister 30 reach a solenoid valve sealing surface 25. A retention spring 27 of a solenoid plunger 28 keeps the solenoid valve sealing surface 25 sealed when the solenoid plunger 28 is not activated. The solenoid 20 includes a solenoid coil 29 on either side of the solenoid plunger 28.

The BOV canister 30 is comprised of a can body 31, a can stem 32, a can base 33, and a can lip 34. The can base 33 and the can body 31 are aligned within the external housing 11 of the base station 10 for proper functioning of the solenoid 20. The can lip 34 is attached to the can base 33 and the can stem 32. The can stem 32 connects to the solenoid body 21 through the hole with interface 22. The hole with interface 22 seals and pushes against the can stem 32.

Figure 3:
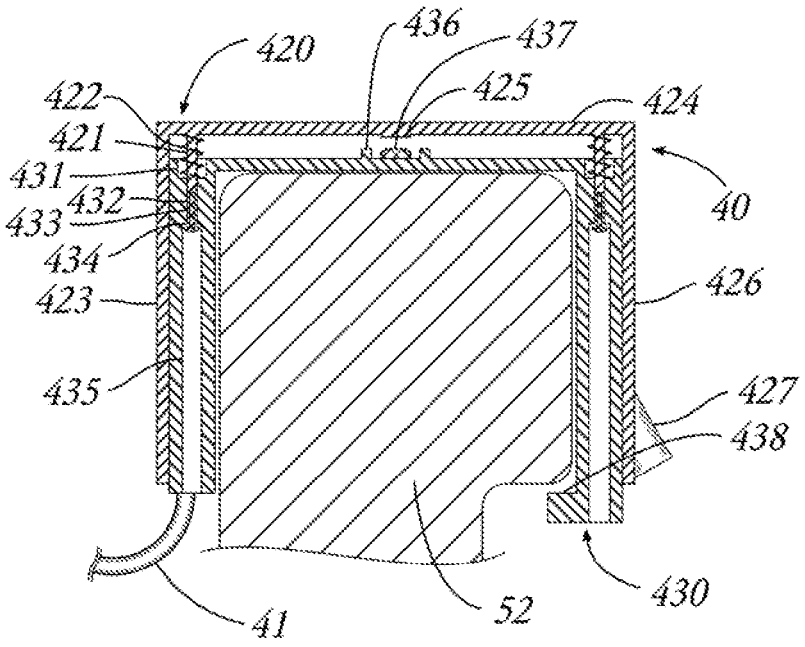
FIG. 3 is a drawing of an example bowl clip in accordance with the invention that attaches to a toilet bowl rim.

FIG. 3 is a drawing of the bowl clip 40 that attaches to the toilet bowl rim 52. The bowl clip 40 includes an upper bowl clip piece 420 and a lower bowl clip piece 430. The upper bowl clip piece 420 is aligned to the lower bowl clip piece 430 using a sliding protrusion 421, a spring 422, and a mating hole 432. The spring 422 is used to separate the upper bowl clip piece 420 from the lower bowl clip piece 430 when not activated. The upper bowl clip piece 420 has an external vertical face 423 and a top horizontal face 424. The external vertical face 423 is facing the outside of the toilet bowl rim 52. The top horizontal face 424 is facing upwards on the top of the toilet bowl rim 52. The lower bowl clip piece 430 includes a centering countersink 431 that counteracts the spring 422 of the upper bowl clip piece 420. There is a screw 433 to attach the upper bowl clip piece 420 to the lower bowl clip piece 430 through the sliding protrusion 421. The screw 433 is designed to prevent separation of the upper bowl clip piece 420 and the lower bowl clip piece 430. The screw 433 is not designed to tighten the upper bowl clip piece 420 to the lower bowl clip piece 430. The screw 433 maintains retention force with a surface for the screw 434. The screw 433 is held in place with a screw installation access hole 435. When a user applies downward pressure on the toilet bowl seat, the upper bowl clip piece 420 is pressed towards the lower bowl clip piece 430. When the upper bowl clip piece 420 is pressed against the lower bowl clip piece 430, a button activation surface 425 contacts a pushbutton switch 437. The pushbutton switch 437 activates the release of the composition from the bag-on-valve (BOV) canister 30. A spacer surface 436 is included to prevent the upper bowl clip piece 420 and the lower bowl clip piece 430 from crushing the pushbutton switch 437. A spray nozzle 427 is attached internally to the tube 41. When the pushbutton switch 437 is activated, the liquid from the bag-on-valve (BOV) canister 30 is dispensed through the tube 41 and into the toilet bowl 51. The lower bowl clip piece 430 includes a clip 438 to prevent removal and keep the bowl clip 40 in place on the toilet bowl rim 52.

FIGS. 4A-D indicate different locations where the base station 10 can be placed. As depicted in FIG. 4A, the base station 10 can be attached to the wall behind the toilet 50. As depicted in FIG. 4B, the base station 10 can be attached to the top of the toilet tank 53. As depicted in FIG. 4C, the base station 10 can be attached to the side of the toilet tank 53. As depicted in FIG. 4D, the base station 10 can be attached to the side of the toilet bowl 51 and/or can be a disposable version of the invention.

FIG. 5 shows an apparatus 60 in accordance with one example embodiment of the invention with an integrated base station 62, tube (not shown separately), and bowl clip 61 implemented in a rim-mounted configuration. As was the case above with regard to the toilet top mount apparatus 888, the base station 62 of rim-mount apparatus 60 includes a solenoid and a bag-on-valve (BOV) canister internal to base station 62. As outlined above, the base stations of the invention can include one or more bag-on-valve (BOV) canisters to deliver one or more compositions to the affected area. The base station 62 of apparatus 60 in FIG. 6 attaches to the toilet bowl 51 with bowl clip 61. The base station 62 is connected to the bowl clip 61 by a tube (obscured by base station 62 and bowl clip 61) of the apparatus 60. The apparatus 60 can also include an indicator light, such as an LED indicator 65 that can be used to show the apparatus 60 is in use, that a composition is in the process of being delivered to the affected area, and that the bag-on-valve (BOV) canister is empty. The rim-mounted apparatus 60 can also include a port 63 from which a composition, such as an aerosol or spray, can be delivered into the room to further treat an affected area. The rim-mounted apparatus 60 can also include a motion sensor 64 which sends an initiation signal that can activate releases of a bowl oil spray, a bowl scented aerosol, and a room scented aerosol from a pressurized bag-on-valve (BOV) canister in the base station 62.

As outlined above, the base stations of the invention can house different numbers and types of containers holding different compositions to be used in preventing and eliminating odors. One example embodiment of the invention includes a base station that holds a single bag-on-valve (BOV) canister with an odor-preventing or odor-eliminating composition, such as a scented aerosol, within the canister.

Figure 6:
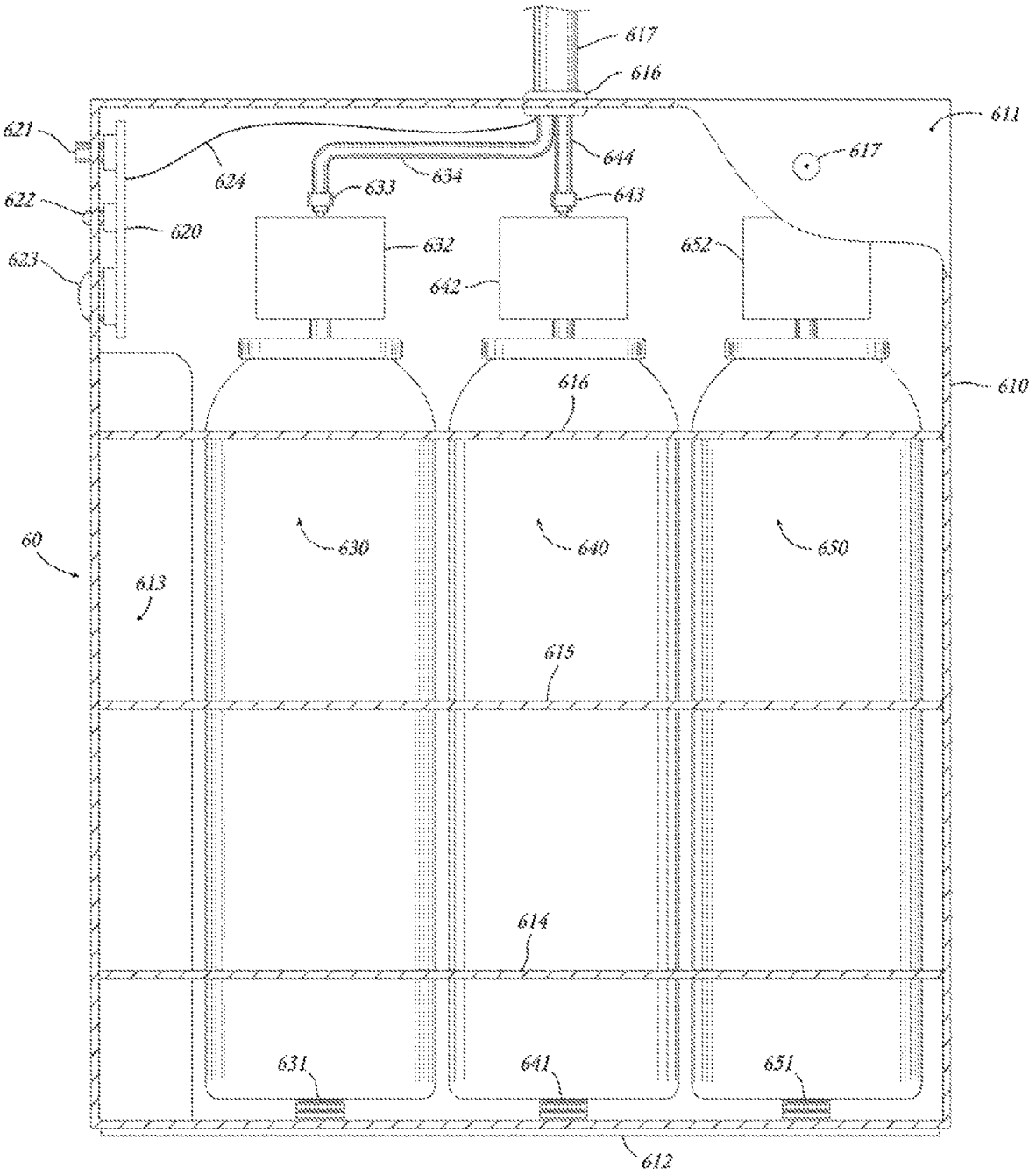
FIG. 6 shows a base station in accordance with one example embodiment with multiple BOV containers, a power supply, and activation circuitry in a larger base unit housing.

Another example embodiment of the invention is shown in FIG. 6 with a base station 60 housing three different bag-on-valve (BOV) canisters 630, 640, 650 used to prevent and eliminate odors. The bag-on-valve (BOV) canisters 630, 640, 650 can be secured in base station 60 using retaining devices, such as retaining clips 631, 641, 651 shown in FIG. 6. Base station 60 also includes a battery compartment 613 housing a battery or other power source. The battery is connected to printed circuit board (PCB) 620 that includes a processor, a memory, a motion sensor 623, indicator 622, and activation switch 621.

The processor and memory of the PCT 620 include computer-executable instructions that are executed by the processor to cause the PCB 620 to carry out the steps outlined above (and below) to read sensor output and switch output and to cause the solenoid to open to dispense flow of a chemical composition from the container(s). Timing and other computer-executable instructions are performed by the circuits and memory and processor on the PCB to dispense the chemical compositions as outlined above and below.

The motion sensor 623, indicator 622, and activation switch 621 are visible from outside the sidewall 610 of the base station 60. Indicator 622 can be an indicator LED or other visual and/or audio indicator that is activated (e.g., lights up, emits an audible sound) when the apparatus with base system 60 is in use. Similarly, indicator 622 can be activated when one or more of the bag-on-valve (BOV) canisters is empty.

In operation, the PCB 620 can receive an initiation signal from activation switch 621 (such as a push button, toggle switch, or other switch) or from motion sensor 623 that activates a solenoid to open and release an odor-preventing or odor-eliminating composition. For example, in one example embodiment of the invention, when a person walks into a bathroom, motion sensor 623 detects their presence and sends an initiation signal that activates and opens solenoid 632, which releases a bowl scented aerosol from pressurized bag-on-valve (BOV) canister 630. The bowl scented aerosol from pressurized bag-on-valve (BOV) canister 630 passes through aerosol tube clamp 633 in tube 634, which is housed in tube 661 (reference numeral 41 in FIG. 1), which is attached to the base station 60 using collar 662.

The tube 661 leads to the toilet bowl 51 via toilet bowl clip 40, for example. The scented aerosol is dispersed in the toilet bowl 51.

In one example embodiment of the invention, a person walks into a bathroom and depresses pushbutton activation switch 621, which sends an initiation signal that activates and opens solenoid 642, which releases a bowl oil spray from pressurized bag-on-valve (BOV) canister 640. The bowl oil spray from pressurized bag-on-valve (BOV) canister 640 passes through aerosol tube clamp 643 in tube 644, which is housed in tube 661 (reference numeral 41 in FIG. 1), which is attached to the base station 60 using collar 662. The tube 661 leads to the toilet bowl 51 via toilet bowl clip 40, for example. The oil spray is dispersed on the surface of the water in the toilet bowl 51 and contains any odors emanating from the water.

Similarly, in one example embodiment of the invention, an activation signal from at least one of activation switch 621 or motion sensor 623 sends an initiation signal that activates and opens solenoid 652, which releases a room scented aerosol from pressurized bag-on-valve (BOV) canister 650. The room scented aerosol from pressurized bag-on-valve canister (BOV) 650 passes through an aerosol tube clamp (obscured by top cover 611) in a tube (obscured by top cover 611), which leads to the spray nozzle 617. The scented aerosol is dispersed into the air in the room and eliminates odors present in the room.

In one example embodiment of the invention, a person sits on the toilet which activates the push button switch 437 (e.g., pressure sensor). The push button switch 437 sends an initiation signal that activates and opens solenoid 642 to release a bowl oil spray from the pressurized BOV canister 640 to the water in the toilet bowl 51. The activation switch 621 can also be activated by a timer which, after a predetermined time from the activation of the push button switch 437, sends an initiation signal that activates and opens solenoid 632 to release the bowl scented aerosol from the BOV canister 630 to the toilet bowl 51. Additionally, upon later release of the push button switch 437 and/or via the activation of the motion sensor 623 by movement, indicating the person has left the toilet, the push button switch 437 and/or motion sensor 623 initiate a signal that activates and opens solenoid 652 to release a room scented aerosol from the BOV canister 650 to the air in the room.

The different embodiments of the invention show that the base unit can be integrated with the bowl clip (such as in the rim-mounted examples) or located separately from the bowl clip in various locations and deliver compositions to the bowl, to the water in the bowl, and to the surrounding room atmosphere via one or more tubes. The base stations can house one or more canisters that hold one or more odor-preventing and/or odor-eliminating compositions. The apparatus can be triggered in several ways, including activation by switch or by sensor.

Disclosed herein is a new apparatus. Also disclosed herein is a new device, which may be used independently or in concert with the disclosed apparatus. Accordingly, in one embodiment, the apparatus disclosed herein includes the device disclosed herein.

Disclosed here is a new apparatus comprising:

a First Container;
a Second Container;
a Third Container;
a First Composition;
a Second Composition;
a First Dispenser;
a Second Dispenser;
a surrounding ambient atmosphere;
wherein the First Dispenser expels the First Composition from within the First Container into the Third Container;
wherein the Second Dispenser expels the Second Composition from within the Second Container into the ambient atmosphere.

In one embodiment, the Third Container comprises water and air. In one embodiment, the Third Container is open to the ambient atmosphere. In one embodiment, the First Composition is held within the First Container and the Second Composition is held within the Second Container.

As used herein, the term "First Container" means a storage device that can be either left open to the atmosphere or closed. In one example, the First Container is a can, bag, bladder, or bottle.

As used herein, the term "Second Container" means a storage device. Within the context of this disclosure the Second Container can be left open to the atmosphere or closed. In one example, the Second Container is a can, bag, bladder, or bottle.

As used herein, the term "Third Container" means a storage device that can be either left open to the atmosphere or closed. In one example, the Third Container is a can, bag, bladder, or bottle. In one example, the Third Container is a tank, chamber, or bowl, such as a toilet or urinal.

As used herein, the term "First Composition" means a chemical or chemical mixture. In one example, the First Composition is an oil and natural oil. In one example, the First Composition is a perfume. In another example, the First Composition is a surfactant. In another example, the First Composition is an oil. In one example, the First Composition is an alcohol. In one example, the First Composition is an antiseptic.

As used herein, the term "Second Composition" means a chemical or chemical mixture. In one example, the Second Composition is an odor absorber. In one example, the Second Composition is a soap. In one example, the Second Composition is a natural oil. In one example, the Second Composition is a perfume. In one example, the Second Composition is an alcohol. In one example, the Second Composition is an antiseptic.

As used herein, the term "First Dispenser" means a device through which a substance can be delivered. In one example, the First Dispenser is a pump system. In one example, the First Dispenser is a nozzle system.

As used herein, the term "Dispenser" includes pressurized or unpressurized delivery systems, such as pressurized spray systems, or gravity mediated drip systems.

As used herein, the term "Second Dispenser" means a device through which a substance can be delivered. In one example, the Second Dispenser is a pump system. In one example, the Second Dispenser is a nozzle system. In one example, the Second Dispenser is an atomizer.

As used herein, the term "ambient atmosphere" means the surrounding atmosphere in which the device or apparatus resides. In one example, the ambient atmosphere is the air within a bathroom or vestibule, which contains a toilet.

As used herein, the term "expels" means to ejecting or causing a material to move out of the container from which it is expelled. In one example, the First Dispenser expels the First Composition from the First Container.

In one embodiment, the First Composition is held within the First Container and the Second Composition is held within the First Container. In one embodiment, at least one of the First Container and the Second Container is a bag on valve container.

As used herein, the term "bag on valve" refers to a pressurized container with a filled bag inside. In one example, the bag inside is a welded bag. In one example, the bag is filled with a composition on the inside and subjected pressure of greater than one atmosphere on the outside. In one embodiment, the bag is contained within a rigid container and a gas having a pressure of greater than one atmosphere fills the space between the bag and rigid container. In one example, the gas creates a pressure on the bag, which expels the composition from the bag.

In one embodiment, at least one of the First Container and the Second Container is a pump bottle.

As used herein, the term "pump bottle" means a bottle with a dispensing mechanism inserted therein. For example, a "pump bottle," within the context of this disclosure includes conventional trigger spray bottles which can squirt, spray or mist fluids. In some embodiments, the term "pump bottle" includes a bottle with a nozzle, said bottle having a dip tube inserted therein and a means for pumping liquid from within the bottle, up through the dip tube, and out of the nozzle.

In one example, the First Dispenser is attached to the First Container.

In one embodiment of the disclosed apparatus, the First Composition includes one or more ingredients chosen from an oil, a natural oil, a perfume, an oxidant, a soap, an acid, a base, a surfactant, an odor absorber, a cyclodextrin, and an antioxidant.

As used herein the term "oil" refers to a nonpolar liquid that can be viscous at ambient temperatures. Within the context of this disclosure, an "oil" can be characterized as being both hydrophobic and lipophilic, and having high carbon and hydrogen content. In one embodiment, the term "oil" refers to a substance that is substantially immiscible with water, creating distinct layers of material as opposed to a single solution.

As used herein, the term "natural oil" refers to oils containing compounds which may be found in plants or animals as opposed to oils which exist only through man-made synthesis. Examples of natural oils within the context of this disclosure include vegetable oils with ethereal salts of glycerin, organic adds such as stearic add, oleic acid, and palmitic acid forming stearin, olein and palmitin, respectively.

As used herein the term "perfume" refers to one or more fragrant volatile molecules, such as aromatic compounds.

As used herein the term "oxidant" can refer to a chemical species that can either remove an electron or transfer electronegative atoms to a substrate. An oxidant can also be referred to as an oxidizing agent. Within the context of this disclosure, examples of oxidants include, chlorinating agents, halogenating agents, peroxides, nitrates, oxygen, ozone, and hypohalite.

As used herein the term "soap" refers to a salt of a fatty acid often characterized for being able to allow insoluble particles to be soluble in water. In one example, the term soap refers to sodium stearate with the following structure:

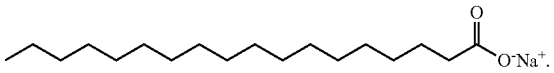

As used herein the term "acid" refers to a chemical substance with a pH of less than 7. In one example, an add has the ability to turn blue litmus red. In one example, an acid has the ability to react with bases and certain metals to form salts. Within the context of this disclosure, examples of adds include acetic add, citric add, phthalic acid, sodium hydroxymethylglycinate, hydrochloric acid, and formic acid.

As used herein the term "surfactant" refers to compounds that lower the surface tension (or interfacial tension) between two liquids or between a liquid and a solid.

As used herein the term "odor absorber" refers to a substance, such as a solid or gel, that neutralizes smells. Within the context of this disclosure, one example of an odor absorber is a cyclodextrin.

As used herein the term "cyclodextrin" (CD) refers to a family of compounds made up of sugar molecules bound together in a ring. Some examples, but not limited to, are α (alpha)-cyclodextrin (6-membered sugar ring molecule), δ (beta)-cyclodextrin (7-membered sugar ring molecule), and y (gamma)-cyclodextrin (8-membered sugar ring molecule). Shown below.

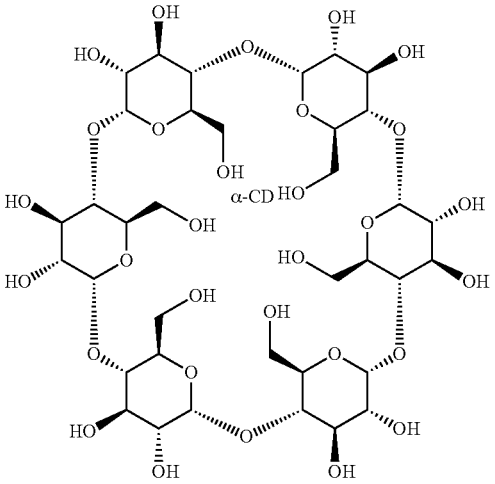

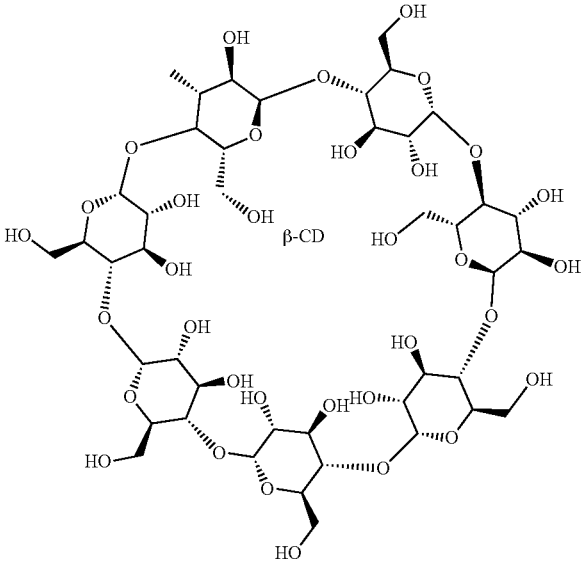

-continued

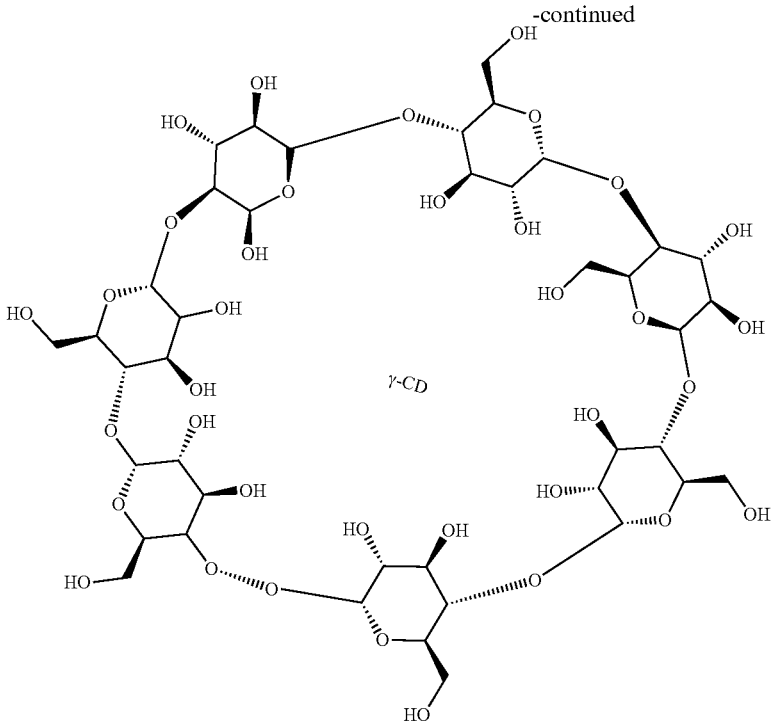

? indicates text missing or illegible when filed

As used herein the term "antioxidant" refers to a chemical agent that lessens oxidation. Within the context of this disclosure, examples of antioxidants include beta carotene, lutein, lycopene, Vitamin C, thiosulfate, Vitamin A, Vitamin E, etc., including salts and derivatives thereof in any proportion.

In one embodiment of disclosed apparatus, the Second Composition includes one or more ingredients chosen from an oil, a natural oil, a perfume, an oxidant, a soap, an acid, a base, a surfactant, an odor absorber, a cyclodextrin, and an antioxidant.

Disclosed herein is a new device comprising:

a Rigid Pressurized Container comprising a First Bladder and Second Bladder;

an Outlet;

wherein said First Bladder comprises a composition having a First Bladder Vapor Pressure;

wherein said Second Bladder comprises a composition having a Second Bladder Vapor Pressure;

wherein said Pressurized Container comprises a vapor pressure greater than one atmosphere of pressure; and wherein said Pressurized Container comprises a vapor pressure greater than said First Bladder Vapor Pressure.

As used herein the term "Rigid Pressurized Container" refers to a container that is sturdy enough withstand pressures higher than 1 atmosphere without compromising the structure of the container. One example of a "Rigid Pressurized Container" is a can or bottle. In one embodiment, the Rigid Pressurized Container is made of plastic. In one embodiment, the Rigid Pressurized Container is made of metal.

As used herein the term "Bladder" mean an inflatable flexible container (e.g., a bag) made of a material capable of holding a liquid composition and capable of bending when exposed to a force, such as a pressure differential. In one example, the bladder is made of rubber. In one example, the bladder is made of plastic. In one example, the bladder is made of metal.

In one embodiment, the Rigid Pressurized Container comprises a First Chamber and a Second Chamber;

wherein the First Bladder is contained within the First Chamber; and wherein the Second Bladder is contained within the Second Chamber.

In one embodiment, the apparatus disclosed herein comprises a Third Composition. In one embodiment, the Third Composition is expelled into the Third Container. In one embodiment, the Third Composition is expelled into the ambient atmosphere. In one embodiment, the Third Composition activates the First Composition.

As used herein the term "activates" refers to reacting with a composition, such as the First Composition, thereby making the composition differently (e.g., more) reactive towards other molecules or chemical reactions.

In one embodiment, the Third Composition activates the Second Composition.

In one embodiment, the Third Composition neutralizes the First Composition.

As used herein the term "neutralizes" refers to lessening the chemical reactivity of a molecule. For example, neutralizing a composition, such as the First Composition, includes reacting with that composition, thereby rendering the composition less reactive towards other molecules or chemical reactions.

In one embodiment, the Third Composition neutralizes the Second Composition.

In one embodiment, the First Container is a different volume from the Second Container.

In one embodiment, each of the First Dispenser and the Second Dispenser is independently chosen from a spray nozzle, an atomizer, and a tube.

As used herein the term "spray nozzle" refers to a device that facilitates dispersion of liquid into a spray.

As used herein the term "atomizer" refers to a device, which forms a dispersion of fine solid particles or liquid droplets upon passing a material through the device.

In one embodiment, the apparatus is coated with an antibacterial.

As used herein the term "antibacterial" refers to a compound that either inhibits bacterial growth or kills bacteria.

In one embodiment, the Third Container is a toilet.

As used herein, the term "toilet" means a sanitation fixture used to collect or dispose of human feces or urine. Examples within the context of this disclosure include conventional toilet bowls, urinals, outhouses, and portable toilets.

In one embodiment, the toilet has a water holding tank. In one embodiment, the First Container is positioned inside the water holding tank.

As used herein, the term "water holding tank" means a tank which holds a cached volume of water for later use, wherein the tank may be filled at a rate that is independent of the rate at which the tank is emptied. In one embodiment, the term "water holding tank" includes a container which holds water along with devices and plumbing for a toilet.

In one embodiment, the toilet has a water holding tank and the First Container is positioned adjacent to the water holding tank.

As used herein, the term "positioned adjacent to the water holding tank" means the First Container is located next to the water holding tank but not inside of the water holding tank.

In one embodiment, the apparatus comprises a First Fill Level Indicator.

In one embodiment, the apparatus comprises a UV light, positioned to radiate the surrounding ambient atmosphere.

In one embodiment, the apparatus comprises a UV light, positioned to radiate the apparatus.

In one embodiment, the toilet has a toilet seat. In one embodiment, the toilet is equipped with a Sensor. In one embodiment, the Sensor triggers deployment of the First Composition.

As used herein, the term "First Fill Level Indicator" means a display means, which provides visible information about the amount of material present within one or more containers. In one embodiment, the "First Fill Level Indicator" is a light, such as an LED light. In one embodiment, the "First Fill Level Indicator" is a display screen.

As used herein, the term "toilet seat" means a hinged unit consisting of a seat (and optionally a lid), which is connected onto a toilet howl for a toilet used in a sitting position.

As used herein, the term "Sensor" means a device that detects stimuli in its surrounding environment. Within the context of this disclosure the term "Sensor" includes infrared, electrical conductance, weight, and/or light sensors.

In one example, the Sensor activates the First Dispenser to deploy the First Composition. In one example, the Sensor detects the presence of a person sitting on a toilet seat of the apparatus. In one example, the apparatus deploys a First Composition into a toilet upon detecting the presence of a person sitting on a toilet seat.

As used herein, the term "trigger" means a stimulus which causes another event to occur. For example, the term "triggers deployment" means that an event (such as a Sensor detection) causes the First Composition to become deployed.

In one embodiment, the Sensor detects a water level in the toilet. In one embodiment, the Sensor detects gravitational force on the toilet set. In one embodiment, the Sensor detects electrical conductance on the toilet seat. In one embodiment, the Sensor triggers deployment of the Second Composition.

Although the present invention herein has been described with reference to various exemplary embodiments, it is to be understood that these embodiments are merely illustrative of the principles and applications of the present invention. Those having skill in the art would recognize that various modifications to the exemplary embodiments may be made, without departing from the scope of the invention.

Moreover, it should be understood that various features and/or characteristics of differing embodiments herein may be combined with one another. It is therefore to be understood that numerous modifications may be made to the illustrative embodiments and that other arrangements may be devised without departing from the scope of the invention.

Furthermore, other embodiments of the invention will be apparent to those skilled in the art from consideration of the specification and practice of the invention disclosed herein. It is intended that the specification and examples be considered as exemplary only, with a scope and spirit being indicated by the claims.

Finally, it is noted that, as used in this specification and the appended claims, the singular forms "a," "an," and "the," include plural referents unless expressly and unequivocally limited to one referent, and vice versa. As used herein, the term "include" or "comprising" and its grammatical variants are intended to be non-limiting, such that recitation of an item or items is not to the exclusion of other like items that can be substituted or added to the recited item(s).

What is claimed is:

1. An apparatus for dispensing an odor-eliminating chemical composition to treat a fluid in a toilet bowl and a second chemical composition to treat an ambient air outside the toilet bowl, comprising:

a base station, including a container storing the chemical composition, a first solenoid to dispense a flow of the chemical composition from the container, the first solenoid operatively connected to the container and responsive to an activation signal indicative of a dispensing condition;

a tube, including a proximal end and a distal end, wherein the proximal end of the tube receives the dispensing flow of the chemical composition from the container and directs the dispensing flow of the chemical composition to the distal end of the tube;

a bowl clip, including a mounting piece and a nozzle, wherein the nozzle receives the dispensing flow of the chemical composition from the distal end of the tube and disperses the chemical composition;

a sensor to identify the dispensing condition to treat the fluid in the toilet bowl and send the activation signal to dispense the chemical composition; and a second solenoid to dispense the second chemical composition to treat the ambient air.

2. An apparatus of claim 1, wherein the chemical composition is pressurized within the container.

3. An apparatus of claim 1, wherein the chemical composition includes at least one of an oil, a natural oil, a perfume, a surfactant, an alcohol, a soap, an odor absorber, a cyclodextrin, an oxidant, an acid, a base, and an antiseptic.

4. An apparatus of claim 1, wherein the container is a bag-on-valve (BOV) canister.

5. An apparatus of claim 1, wherein the container is pump bottle.

6. An apparatus of claim 1, further comprising:

a second sensor that identifies a second dispensing condition to activate the second solenoid.

7. An apparatus of claim 6, wherein the second sensor is a motion sensor.

8. An apparatus of claim 1, wherein the sensor is mounted to the bowl clip.

9. An apparatus of claim 1, wherein the sensor is mounted to the base unit.

10. An apparatus of claim 1, wherein the dispensing condition includes receipt of an actuation signal from a switch.

11. An apparatus of claim 1, further comprising:

a third solenoid to disperse a third chemical composition into the toilet bowl.

12. An apparatus of claim 11, wherein the third solenoid activates based on another sensor identifying a third dispensing condition.

13. An apparatus of claim 1 further comprising:

a battery power supply included in the base station, the battery power supply providing actuation power to the first solenoid for dispensing flow of the chemical composition from the container upon receipt of the activation signal indicative of the dispensing condition.

14. An apparatus of claim 13 further comprising:

a mounting bracket extending from the base station to the bowl clip, wherein extending the mounting bracket activates the battery power supply.

15. An apparatus of claim 1 further comprising:

a mounting bracket operatively connected from the base station to the bowl clip, wherein extending the mounting bracket activates the battery power supply.

16. An apparatus of claim 1 further comprising:

an ultraviolet (UV) light operatively connected to the bowl clip and further positioned to radiate ambient air in the toilet bowl.

* * * * *